252-99 AU 166 EX
11/3/81 XR 4,298,492

United States Patent [19]

van den Brom

[11] 4,298,492

[45] Nov. 3, 1981

[54] BUILT LIQUID DETERGENT COMPOSITION

[75] Inventor: Guido C. van den Brom, Nieuw-Beijerland, Netherlands

[73] Assignee: Lever Brothers Company, New York, N.Y.

[21] Appl. No.: 157,596

[22] Filed: Jun. 9, 1980

[30] Foreign Application Priority Data

Jun. 21, 1979 [GB] United Kingdom ..... 21744/79
Nov. 9, 1979 [GB] United Kingdom ..... 38987/79

[51] Int. Cl.[3] ..... C11D 7/56
[52] U.S. Cl. ..... 252/97; 252/99; 252/110; 252/173; 252/DIG. 14
[58] Field of Search ..... 252/110, 97, DIG. 14, 252/173, 99

[56] References Cited

U.S. PATENT DOCUMENTS 4,153,569 5/1979 van den Brom ..... 252/DIG. 14 X

FOREIGN PATENT DOCUMENTS 633154 12/1961 Canada ..... 252/DIG. 14
1093935 12/1967 United Kingdom .
1126479 9/1968 United Kingdom .

*Primary Examiner*—Mayer Weinblatt

[57] ABSTRACT

By inclusion of an alkali metal soap and an alkanolamine in a liquid detergent composition which contains a mixture of sodium tripolyphosphate and tetrapotassium pyrophosphate, a stable liquid, both at 0° C. and at 52° C. is obtained, in the presence of a hydrotrope. This system can also incorporate hydrogen peroxide, without any detrimental effect on its chemical or physical stability.

4 Claims, No Drawings

BUILT LIQUID DETERGENT COMPOSITION

The present invention relates to an aqueous, built liquid detergent composition, in which the builder system is or comprises a mixture of an alkali metal tripolyphosphate and an alkali metal pyrophosphate.

Aqueous, built liquid detergent compositions containing such a builder mixture are already known in the art. Thus, NL 7710697 describes built liquid detergent compositions comprising a mixture of sodium tripolyphosphate and tetrapotassium pyrophosphate. This composition, however, also requires the presence of a particular copolymer to impart to this composition a sufficient phase stability. Although these compositions do show a satisfactory storage stability under ordinary conditions, they are not optimal for storage under extreme and/or varying conditions e.g. at temperatures of 0° C. or 52° C.

One of the objects of the present invention is to provide an aqueous, built liquid detergent composition comprising the above phosphate builder mixture, which is stable both at 0° C. and at 52° C.

It has now been found that this object can be achieved by inclusion in such an aqueous, built liquid detergent composition of an alkali metal fatty acid soap and an alkanolamine.

It is in this respect already known to include an alkanolamine in an aqueous, built liquid detergent composition which contains a mixture of an alkali metal tripolyphosphate and an alkali metal pyrophosphate. Thus, British Patent Sepecification No. 1,093,935 describes such a composition, wherein triethanolamine is included inter alia to improve the homogeneity and storage stability of such built liquid detergents. The amount of triethanolamine required according to this Specification ranges however from 2 to 10% by weight. Experiments have however shown that such amounts of triethanolamine do not provide an aqueous built liquid detergent composition which is satisfactorily stable between 0° C. and 52° C. Moreover, compositions according to this prior proposal do not contain an alkali metal soap.

Another British Patent Specification No. 1,126,479, describes an aqueous, built liquid detergent of the emulsion type, which may contain a mixture of an alkali metal tripolyphosphate and an alkali metal pyrophosphate. An alkanolamine may also be included to adjust the pH, and the composition furthermore requires the presence of a particular copolymer to prevent a nonionic detergent present in the composition from separating out. The amount of alkanolamine is well above 2%; the Examples use 8.5% or higher. Where mixtures of sodium tripolyphosphate and tetrasodium pyrophosphate are exemplified, the amounts thereof are 4% (Example 12), which are relatively low amounts not providing optimal detergency. Again these compositions do not contain an alkali metal soap.

It has now been found that by inclusion in an aqueous, built liquid detergent composition comprising a mixture of sodium tripolyphosphate and tetrapotassium pyrophosphate, of an alkali metal soap, a hydrotrope and up to 2% by weight of an alkanolamine, a clear, isotropic composition is obtained which is stable for at least one month both at 0° C. and at 52° C. The use of a copolymer as stabilizing agent can thereby be avoided, and the amount of phosphate builders, tolerable in such a composition, is thereby higher than suggested in the above prior art.

Both the alkali metal soap and the alkanolamine should be present in the compositions of the invention; when this combination is not present, phase instability between 0°-52° C. occurs. Furthermore, if the amounts of triethanolamine is above 2% by weight, either in the presence or in the absence of the soap, phase instability, especially at the lower temperatures, occurs.

The invention will now be described in more detail.

The alkali metal tripolyphosphate used is sodium tripolyphosphate. The amount thereof ranges from 2 to 13% by weight, preferably from 6 to 12% by weight. Any type of sodium tripolyphosphate can be used, irrespective of their Phase I content.

The alkali metal pyrophosphate used is tetrapotassium pyrophosphate, in an amount ranging from 2 to 16% by weight, preferably from 4 to 10% by weight. Up to 15% by weight of the tetrapotassium pyrophosphate can be replaced by tetrasodium pyrophosphate without impairing the benefits of the invention. The alkali metal soap used is an alkali metal soap of branched or straight chain, saturated or unsaturated, natural or synthetic fatty acids having an alkyl chain with 8 to 22 carbon atoms. Preferred fatty acids are the $C_{10}$–$C_{14}$ fatty acids, such as the fatty acids derived from coconut oil. The soap is used in an amount of 0.1 to 8% by weight, preferably from 0.5 to 2% by weight. Preferred is potassium soap, particularly in formulations with a high sodium cation level.

The alkanolamine used is a mono-, di- or trialkanolamine in which the alkanol group is ethanol or isopropanol. Triethanolamine is preferred. The alkanolamine is used in an amount of 0.1 to 2% by weight, preferably 1% by weight.

The hydrotrope required in the present invention is present in an amount of 1 to 15%, preferably 5 to 10% by weight. Suitable examples are the alkali metal, ammonium and substituted ammonium salts of xylene-, toluene- and cumenesulphonic acid; alkyl phosphonic acids, alkyl- and alkenyl succinic acids, etc. The potassium salts are preferred.

The compositions of the invention furthermore contain, as an essential ingredient, one or more of an active detergent of the anionic, nonionic, cationic or zwitterionic class.

Many suitable detergent-active compounds are commercially available and are fully described in the literature, for example in "Surface Active Agents and Detergents", Volumes I and II, by Schwartz, Perry and Berch.

The preferred detergent compounds which can be used are synthetic anionic compounds. These are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium primary or secondary alkyl sulphates, especially those obtained by sulphating the higher ($C_8$–$C_{18}$) alcohols produced by reducing the glycerides of tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_9$–$C_{18}$)

fatty alcohol-alkylene oxide, particularly ethylene oxide, reaction products; the reaction products of fatty acids such as coconut fatty acids esterified with isethionic acid neutralized with sodium hydroxide; sodium and potassium salts of fatty acid amides of methyl taurine; primary or secondary alkane monosulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate; and olefin sulphonates, which term is used to describe the material made by reacting olefins, particularly alpha-olefins, with $SO_3$ and then neutralizing and hydrolyzing the reaction product.

Although in general the sodium salts of the anionic detergent compounds are preferred for cheapness, the potassium salts can sometimes be used to advantage, particularly in compositions with high levels of other sodium salts such as sodium tripolyphosphate.

Of the anionic detergent compounds, alkali metal alkyl ($C_{10}$–$C_{15}$) benzene sulphates are particularly preferred, both for ready availability and cheapness and also for their advantageous solubility properties.

If desired, nonionic detergent active compounds may be used as the sole detergent compounds, or preferably in admixture with anionic detergent compounds, especially the alkyl benzene sulphonates. Examples includes the reaction products of the alkylene oxides, usually ethylene oxide, with alkyl ($C_6$–$C_{22}$) phenols, generally 5 to 25 EO, i.e. 5 to 25 units of ethylene oxide per molecule, the condensation products of aliphatic ($C_8$–$C_{18}$) primary or secondary alcohols with ethylene oxide, generally 2 to 30 EO, e.g. 6 to 20 EO, and products made by condensation of ethylene oxide with the reaction products of propylene oxide and ethylene diamine. Another example of suitable nonionics are nonionics obtained by first ethoxylating and subsequently propoxylating an organic hydroxyl-group containing radical, e.g. an aliphatic primary or secondary $C_8$–$C_{18}$ alcohol. Other so-called nonionic detergent active compounds include long chain tertiary amine oxides, long chain tertiary phosphine oxides and dialkyl sulphoxides.

Mixtures of detergent active compounds, for example mixed anionic or mixed anionic and nonionic compounds may be used in the detergent compositions, particularly to impart thereto controlled low sudsing properties or to improve the detergency. This is particularly beneficial for compositions intended for use in suds-intolerant automatic washing machines. Mixtures of amine oxides and ethoxylated anionic compounds can also be beneficial.

Amounts of amphoteric or zwitterionic detergent active compounds can also be used in the liquid detergent compositions of the invention, but this is not normally desired owing to their relatively high cost. If any amphoteric or zwitterionic detergent active compounds are used, it is generally in small amounts in compositions based on the much more commonly used anionic and/or nonionic detergent active compounds.

The amount of the detergent active compound or compounds used is generally in the range of from about 2.0% to about 20%, preferably about 5% to about 15%, by weight of the compositions, depending on the desired properties. Lower levels of nonionic detergent compounds should be used within this range as they tend to form a separate liquid phase if used at higher levels, that is over about 5% by weight.

The liquid detergent compositions of the invention can contain any of the conventional additives in the amounts in which such additives are normally employed in liquid fabric washing detergent compositions. Examples of these additives include lather boosters such as alkanolamides, particularly the monoethanolamides derived from palm kernel fatty acids and coconut fatty acids, later depressants such as alkyl phosphates, and silicones, antiredeposition agents such as sodium carboxymethylcellulose, alkaline salts such as sodium silicate, alkali metal carbonate such as potassium carbonate or alkali metal hydroxides, fabric softening agents, and usually present in very minor amounts, fluorescent agents, perfumes, enzymes such as protease and amylases, germicides and colourants. They may also contain bleaching agents, such as peroxy compounds. In this respect it has been found that hydrogenperoxide can be included in the above liquid detergent compositions to provide a liquid bleach composition having adequate washing and bleaching performance combined with good physical and chemical stability. The hydrogenperoxide is present in an amount of 1.5 to 7.5% by weight of the total composition, perferably in such an amount that it can deliver from about 100 to 150 mg/literactive oxygen in the wash.

The balance of the composition is water, which is usually present to the extent of about 40% to about 75% by weight, preferably about 45% to about 65% by weight.

To ensure effective detergency the liquid detergent compositions should be alkaline, and it is preferred that they should provide a pH within the range of about 8.5 to 12, preferably about 9 to about 11 when used in aqueous solutions of the composition at the recommended concentration. To meet this requirement, the undiluted liquid composition should also be of high pH, for example about pH 9 to about 12.5. It should be noted that an excessively high pH, e.g. over about pH 13, is less desirable for domestic safety. If hydrogenperoxide is present in the liquid composition, then the pH is generally from 7.5 to 10.5, preferably 8 to 10 and especially 8.5 to 10, to ensure the combined effect of good detergency and good physical and chemical stability. The ingredients in any such highly alkaline detergent composition should of course be chosen for alkaline stability, especially for pH-sensitive materials such as enzymes, and a particularly suitable proteolytic enzyme in this respect is available under the tradename "Esperase". The pH may be adjusted by addition of a suitable alkaline material.

It is desirable to include in the composition an alkaline buffer, for example an alkali metal carbonate such as potassium carbonate, to maintain the pH of at least 9 during use, particularly for example in hard water or at low product concentrations.

The compositions of the invention may be prepared in any suitable way; a preferred method is, however, dissolving the hydrotrope and the alkali (for the in situ neutralization of anionic surfactant and fatty acid) in water of room temperature, adding the acid anionic surfactant and heating the mix to 55° C. under agitation. Subsequently a premix consisting of the nonionic active, fatty acid and, if required, the lather booster with a temperature above the melting temperature of the components, should be dissolved in the mix. The builder and buffer salts including triethanolamine should be added as the final components, as well as the hydrogenperoxide, if present.

The present invention will now be further illustrated by way of Example.

EXAMPLE 1

The following composition was prepared:

| | % by weight |
|---|---|
| potassium linear $C_{11,3}$ alkylbenzene sulphonate (98% active) | 9 |
| $C_{13}$-$C_{15}$ linear alcohol, condensed with 7 moles of ethylene oxide | 2 |
| coconut fatty acid monoethanolamide | 1 |
| sodium tripolyphosphate | 10 |
| tetrapotassium pyrophosphate | 9 |
| potassium coconut fatty acid soap | 1.3 |
| triethanolamine | 1 |
| potassium xylene sulphonate | 7 |
| potassium carbonate | 2 |
| water | balance |

This product was prepared in the following way 70 g potassium xylene sulphonate and 35 g potassium hydroxide (50% solution) were dissolved in 555 g distilled water of 21° C. Subsequently 80 g alkylbenzene sulphonic acid (98% active) were added and this mix was heated to 57° C. under continuous agitation. A permix consisting of a clear mixture of 20 g fatty alcohol ethoxylate, 10 g coconut fatty acid and 10 g coconut fatty acid monoethanolamide of 77° C. was then added to the mix. After dissolution 100 g sodium triphosphate, 90 g potassium pyrophosphate and 20 g potassium carbonate were added. Finally 10 g triethanolamine were added and the mix was agitated for 10 minutes. The batch was weighed back and 10 g distilled water were added under agitation to compensate for evaporation.

The pH of the neat product was 12.5; the pH of a 0.25% aqueous solution was 10.0. The product had a density of 1.22 and a viscosity (Brookfield; 30 rpm: Spindle no. 3) of 40 cP.

EXAMPLE 2

(Low pH product).

| | % by weight |
|---|---|
| potassium linear $C_{11,3}$ alkylbenzene sulphonate | 9 |
| $C_{13}$-$C_{15}$ linear alcohol, condensed with 7 moles of ethylene oxide | 2 |
| coconut fatty acid monoethanolamide | 1 |
| sodium tripolyphosphate | 10 |
| tetra potassium pyrophosphate | 9 |
| potassium coconut fatty acid soap | 1.3 |
| triethanolamine | 1 |
| potassium toluene sulphonate | 7 |
| potassium metaborate | 2 |
| miscellaneous (fluorescer, perfume, dye) | 0.5 |
| water | balance |

The pH of the neat product was 10.0; the pH of a 0.5% aqueous solution was 9.0; viscosity=40 cP (Brookfield, Spindle 1, 6 rpm). The product was storage stable for at least 1 month at 52° C. and for 2 months at 0° C. and for 12 months at ambient temperature.

EXAMPLE 3

A product according to Example 1 was prepared, using:

$C_{12}$-$C_{13}$ linear alcohol, condensed with 6.5 moles of ethylene oxide instead of the $C_{13}$-$C_{15}$ linear alcohol, condensed with 7 moles of EO.

lauryl isopropanolamide instead of coconut fatty acid monoethanolamide.

The product had the following characteristics pH=12.5, viscosity=40 cP (Brookfield, Spindle 1, 6 rpm). The product was storage stable for at least 1 month at 52° C., for 2 months at 0° C. and for 12 months at ambient temperature.

EXAMPLE 4

A product according to Example 1 was prepared, using:

1% sodium lauryl ethersulphate ($C_{12}$-$C_{15}$.3EO) instead of the 2% of the $C_{13}$-$C_{15}$ linear alcohol, condensed with 7 moles of EO, 2% lauryldiethanolamide instead of 1% of coconut fatty acid monoethanolamide, potassium toluene sulphonate instead of potassium xylene sulphonate.

The product had the following characteristics pH=12.5, viscosity=50 cP (Brookfield Spindle 1,6 rpm). The product was storage stable for at least 1 month at 52° C., for 2 months at 0° C. and for 12 months at ambient temperature.

EXAMPLE 5

The following product was prepared:

| | % by weight |
|---|---|
| potassium linear $C_{11,9}$ alkylbenzene sulphonate (89% active) | 9.4 |
| $C_{12}$-$C_{13}$ linear alcohol, condensed with 6.5 moles of ethylene oxide | 2 |
| potassium xylene sulphonate | 7 |
| sodium tripolyphosphate | 8.8 |
| sodium pyrophosphate | 1.1 |
| potassium pyrophosphate | 9 |
| lauric isopropanolamide | 1 |
| triethanolamine | 1 |
| potassium carbonate | 2 |
| miscellaneous (fluorescer, antiredeposition agent, dye, perfume) | 0.9 |
| water | balance |

The product had the following characteristics: pH=12.5, viscosity=400 cP (Brookfield Spindle 1, 6 rpm). The product was storage stable for at least 1 month at 52° C., for 2 months at 0° C., for 12 months at ambient temperature.

EXAMPLES 6-9

The following built liquid detergent compositions were prepared:

| | % by weight | | | | | | |
|---|---|---|---|---|---|---|---|
| Composition | 6 | 7 | 8 | 9 | A | B | C |
| Potassium linear $C_{11,3}$ alkylbenzene sulphonate (98% active) | 9 | 9 | 9 | 9 | 9 | 9 | 9 |
| $C_{13}$-$C_{15}$ linear alcohol, condensed with 7 moles of EO | 2 | 2 | 2 | 2 | 2 | 2 | 2 |

-continued

| Composition | % by weight | | | | | | |
|---|---|---|---|---|---|---|---|
| | 6 | 7 | 8 | 9 | A | B | C |
| Potassium xylene sulphonate | 7 | 7 | 7 | 7 | 7 | 7 | 7 |
| Potassium coconut fatty acid soap | 1.3 | 1.3 | 1.3 | 1.3 | 1.3 | 1.3 | 1.3 |
| Triethanolamine | 1 | 1 | 1 | — | — | — | — |
| Monoethanolamine | — | — | — | 1 | — | — | — |
| Sodium triphosphate | 10 | 10 | 10 | 10 | 10 | 10 | 10 |
| Tetrapotassium pyrophosphate | 9 | 9 | 9 | 9 | 9 | 9 | 9 |
| Coconut fatty acid monoethanolamide | 1 | 1 | 1 | 1 | 1 | 1 | 1 |
| Potassium metaborate ($K_3BO_3$) | 2 | 2 | 2 | 2 | — | — | — |
| $K_2CO_3 . KHCO_3$ | — | — | — | — | 2 | 2 | 2 |
| Ethane hydroxydisphosphonic acid (EHDP) | — | 0.5 | — | — | — | — | — |
| Ethylene diamine tetra (methylene phosphonic acid) EDTMP | — | — | — | — | — | 0.25 | — |
| Diethylenetriamine penta (methylene phosphonic acid) DTPMP | — | — | 0.25 | — | — | — | 0.25 |
| Water pH = 10 | ← up to 100% → | | | | | | |

To each of these compositions was added 15% by weight of hydrogen peroxide solution (30%) and storage stability trials were carried out at 20° C. and 37° C.

The half-life times (period in which 50% of the initial bleach has been decomposed) of the bleach composition in days were measured. The results are tabulated below.

TABLE 1

| Composition | Half-life time in days | |
|---|---|---|
| | 20° C. | 37° C. |
| 1 | >80 | 30 |
| 2 | >45 | 10 |
| 3 | >95 | 32 |
| 4 | >30 | 25 |
| A | 7 | 1 |
| B | 3 | 1 |
| C | 26 | 2 |

The above results show the superior stability of the compositions 6–9 of the invention over the compositions A-C outside the invention.

EXAMPLE 10

Washing and bleaching performance of composition Example 6 was compared with a powdered heavy duty detergent product of the following formulation:

| | % by weight |
|---|---|
| sodium dodecyl benzene sulphonate | 7.5 |
| $C_{14}$—$C_{15}$ linear alcohol condensed with 11 moles of ethylene oxide | 3.0 |
| sodiunm coconut fatty acid soap | 3.0 |
| sodium stearate | 5.0 |
| sodium silicate | 6.2 |
| sodium triphosphate | 33.0 |
| sodium carboxymethylcellulose | 0.6 |
| sodium sulphate | 16.0 |
| miscellaneous (fluorescer, dye, perfume) | 2.7 |
| water | 6.0 |
| sodium perborate tetrahydrate | 17.0 |

The washing experiments were carried out in the Tergotometer under the following washing conditions:

-continued

| | |
|---|---|
| Tap water: | 9° German hardness |
| Temperature: | 90° C. |
| Washing time: | 30 minutes (including 10 minutes heating up) |
| Product dosage: | 6 g/liter. |

The amount of bleach in both liquid and solid (powder) products has been matched and should deliver 105 mg/liter active oxygen in the wash.

The results are given in the following Table 2.

TABLE 2

Elrepho measurements using a filter which faces out fluorescer effect.

| | Bleaching effect on tea stains | | | |
|---|---|---|---|---|
| | Liquid composition 1 | | Powder | |
| | Base | + $H_2O_2$ | Base | + $H_2O_2$ |
| Reflectance | −2.0 | 13.0 | 4.6 | 21.0 |
| Reflectance increase | | Δ = 15.0 | | Δ = 16.4 |
| | % Detergency | | | |
| | 24.1 | 28.7 | 25.5 | 28.8 |
| | 35.2 | 37.6 | 38.0 | 39.0 |
| pH of suds after washing | 8.8 | 8.6 | 9.5 | 9.7 |

The above results show that the built liquid detergent bleach composition of the invention compares very well in detergency and bleaching performance with a heavy duty powder containing 17% perborate.

I claim:

1. An aqueous, built liquid detergent composition comprising:

(a) from 2 to 20% by weight of an anionic, nonionic, cationic or zwitterionic synthetic detergent active compound or mixtures thereof;

(b) from 2 to 13% by weight of sodium tripolyphosphate;

(c) from 2 to 16% by weight of tetrapotassium pyrophosphate;

(d) from 0.1 to 8% by weight of an alkalimetal $C_8$–$C_{22}$ fatty acid soap;

(e) from 0.1 to 2% by weight of mono-, di- or triethanol or -isopropanolamine;

(f) from 1–15% by weight of a hydrotrope;

(g) from 40–75% by weight of water.

2. A composition according to claim 1, comprising:

5–15% by weight of (a)
6–12% by weight of (b)
4–10% by weight of (c)
0.5–2% by weight of (d)
1% by weight of (e)
5–10% by weight of (f) and
45–65% by weight of (g).

3. A composition according to claim 1, wherein (e) is triethanolamine.

4. A composition according to claim 1, further comprising from 1.5 to 7.5% by weight of hydrogen peroxide.

* * * * *